US011131114B2

(12) United States Patent
Magnan

(10) Patent No.: US 11,131,114 B2
(45) Date of Patent: Sep. 28, 2021

(54) TRIM ASSEMBLY FOR A DOOR LOCK AND METHOD OF ASSEMBLING A HANDLE THEREOF

(71) Applicant: DORMAKABA CANADA INC., Montréal (CA)

(72) Inventor: Patrice Magnan, Montreal (CA)

(73) Assignee: DORMAKABA CANADA INC., Montreal (CA)

( * ) Notice: Subject to any disclaimer, the term of this patent is extended or adjusted under 35 U.S.C. 154(b) by 351 days.

(21) Appl. No.: 16/453,068

(22) Filed: Jun. 26, 2019

(65) Prior Publication Data

US 2020/0018090 A1 Jan. 16, 2020

Related U.S. Application Data

(60) Provisional application No. 62/697,157, filed on Jul. 12, 2018.

(51) Int. Cl.

| | |
|---|---|
| ***E05B 3/06*** | (2006.01) |
| ***E05B 9/00*** | (2006.01) |
| ***E05B 1/00*** | (2006.01) |
| ***E05B 9/08*** | (2006.01) |
| ***E05B 3/10*** | (2006.01) |

(52) U.S. Cl.

CPC ..... *E05B 3/06* (2013.01); *E05B 3/10* (2013.01); *E05B 9/002* (2013.01); *E05B 9/08* (2013.01); *E05B 1/003* (2013.01)

(58) Field of Classification Search

CPC ... E05B 1/00; E05B 1/003; E05B 3/00; E05B 3/003; E05B 3/04; E05B 3/06; E05B 3/10; E05B 9/00; E05B 9/002; E05B 9/08

See application file for complete search history.

(56) References Cited

U.S. PATENT DOCUMENTS

| | | | |
|---|---|---|---|
| 2,190,951 | A | 2/1940 | Roach |
| 4,042,268 | A | 8/1977 | Coglan |
| 4,569,547 | A | 2/1986 | Fayerman et al. |

(Continued)

FOREIGN PATENT DOCUMENTS

| | | | |
|---|---|---|---|
| CA | 2698851 | C | 10/2010 |
| CN | 87100489 | A | 9/1987 |

(Continued)

*Primary Examiner* — Christopher J Boswell

(74) *Attorney, Agent, or Firm* — Norton Rose Fulbright Canada LLP; Alexandre Daoust

(57) ABSTRACT

The method can include: introducing a neck portion of the handle in a receiving aperture of the frame and thereby positioning a second engagement member of the neck into a tangential engagement with a first engagement member of a rotary holder, and positioning a transversal groove defined in the neck portion in axial alignment with a clip axially trapped in a cam cavity of the frame, the clip further being tangentially trapped by the rotary holder but free to slide in a radial orientation relative to the rotary holder; and rotating the rotary holder around the rotation axis, via rotation of the handle, along a camming angle, the rotary holder thereby pivoting a clip around the rotation axis, inside a cam cavity, the cam cavity pushing the clip radially inwards during said pivoting, until it is engaged in the transversal groove, preventing axial retraction of the neck portion thereafter.

21 Claims, 9 Drawing Sheets

(56) References Cited

U.S. PATENT DOCUMENTS

| | | | | |
|---|---|---|---|---|
| 4,676,083 | A * | 6/1987 | Sedley | E05B 13/005 70/276 |
| 5,067,758 | A | 11/1991 | Fann et al. | |
| 5,441,318 | A * | 8/1995 | Ghostley | E05B 3/04 292/336.3 |
| 5,562,317 | A * | 10/1996 | Kuo | E05B 3/06 292/359 |
| 6,241,295 | B1 * | 6/2001 | Hoogendoorn | E05B 3/06 292/348 |
| 6,491,327 | B1 * | 12/2002 | Fan | E05B 3/065 292/336.3 |
| 6,997,024 | B2 * | 2/2006 | Etlicher | E05B 13/004 292/336.3 |
| 8,070,194 | B2 | 12/2011 | Houis | |
| 9,422,755 | B2 * | 8/2016 | Van Parys | E05B 3/08 |
| 10,724,270 | B2 * | 7/2020 | Lehner, Jr. | E05B 3/06 |
| 10,890,020 | B2 * | 1/2021 | Moon | E05B 63/0065 |
| 2005/0125954 | A1 | 6/2005 | Shyu | |
| 2006/0042337 | A1 | 3/2006 | Su | |
| 2006/0125248 | A1 * | 6/2006 | Heeley | E05B 3/06 292/336.3 |
| 2020/0308867 | A1 * | 10/2020 | Leclercq | E05B 3/04 |
| 2021/0148136 | A1 * | 5/2021 | Kim | E05B 1/003 |

FOREIGN PATENT DOCUMENTS

| | | | |
|---|---|---|---|
| CN | 1771148 | A | 5/2006 |
| CN | 105401787 | A | 3/2016 |
| FR | 2960582 | A1 | 12/2011 |
| GB | 2341658 | A | 3/2000 |

* cited by examiner

TRIM ASSEMBLY FOR A DOOR LOCK AND METHOD OF ASSEMBLING A HANDLE THEREOF

FIELD

The improvements generally relate to the field of door locks, and more specifically to trims therefore.

BACKGROUND

Some door locks, such as mortise locks for instance, are designed for use with a pair of trims. In the case of a mortise lock, the lock system is provided in a pocket designed to be housed within a cavity (the mortise) which is defined in the door. A trim assembly can be provided on each side of the door, with each trim assembly having a frame designed to be secured to the corresponding face of the door. Trim assemblies can be designed to house a handle rotation mechanism, for instance, which can include a return spring and some form of rotary bearing for the handle. Trims are typically designed to have an appealing appearance and a suitable functionality.

Trims, as a practical manner, are typically to be packaged and shipped for installation. It was common practice for trims to be fully assembled in the factory and to be shipped in their assembled configuration. Depending on the type of handle (knob, lever, etc), the assembled trim can have a somewhat awkward shape from a packaging perspective. This was especially the case for handles designed for a rotation axis perpendicular to the plane of the door face, and for lever handles in particular which typically also project laterally relative to the trim edge.

Moreover, non-symmetrical handles, such as lever handles for instance, needed to be oriented either towards the left side, or the right side, depending on the configuration of the door it was to be mounted to (a lever handle is typically biased to point inwardly relative to the edge of the door which opens). This need was met by manufacturing two different configurations of each model of trim: a right side configuration and a left side configuration. Keeping both configurations in inventory was inconvenient. Moreover, the purchaser needed to identify and specify which configuration was required at the time of purchase, which could lead to ordering or shipping errors and corresponding inconveniences.

There always remains room for improvement.

SUMMARY

It was found that the volume of the trim's shipping package could be significantly reduced if the handle and the remainder of the trim could be separated during shipping. Indeed, in the case of a lever handle for instance, the lever handle could be oriented in a plane roughly parallel to the plane of the remainder of the frame (typically of a generally rectangular prism shape) and snugly packaged in a significantly smaller box.

However, this created the challenge of designing the handle attachment mechanism in a manner for the handle assembly step to be simple and intuitive, while maintaining an aesthetic final appearance and suitable functionality.

In the case of some non-symmetrical handles, such as lever handles for instance, it was sought to allow selecting the right side or left side configuration at the point of installation, rather than specifying it upon ordering, as this could simplify the ordering, manufacturing, inventory management and/or shipping processes. However, there was a challenge in designing a handle attachment mechanism which could be selectively assembled into a left side or right side configuration at the point of installation.

In accordance with one aspect, there is provided a trim assembly for a lock having a rotation axis extending normal to a plane of a door, the trim assembly comprising: a frame configured to be secured to a face of the door, the frame having a cam cavity extending transversally to the rotation axis, the cam cavity having a major depth along a first radial axis, a minor depth along a second radial axis, and a camming face having a reducing radial depth along a camming angle extending from the major depth to the minor depth, a clip having a transversally-oriented planar body received in the cam cavity, the clip having a radially-outer edge configured to slidingly engage the camming face, a rotary holder rotatably mounted to the frame around the rotation axis, the rotary holder having a first handle engagement member and a clip holder, the clip holder allowing radial sliding displacement of the clip while preventing rotational displacement of the clip relative to the rotary holder, and a handle having a neck portion having a second engagement member tangentially engaged with the first engagement member, the handle having a transversal groove receiving a radially-inner edge of the clip.

In accordance with another aspect, there is provided a method of assembling a handle to a frame component of a lock having a rotation axis extending normal to a plane of the door, the method comprising: introducing a neck portion of the handle in a receiving aperture of the frame and thereby positioning a second engagement member of the neck into a tangential engagement with a first engagement member of a rotary holder, and positioning a transversal groove defined in the neck portion in axial alignment with a clip axially trapped in a cam cavity of the frame, the clip further being tangentially trapped by the rotary holder but free to slide in a radial orientation relative to the rotary holder; rotating the rotary holder around the rotation axis, via rotation of the handle, along a camming angle, the rotary holder thereby pivoting a clip around the rotation axis, inside a cam cavity, the cam cavity pushing the clip radially inwards during said pivoting, until it is engaged in the transversal groove, preventing axial retraction of the neck portion thereafter.

In accordance with still another aspect, there is provided a handle connection mechanism for a lock having a rotation axis extending normal to a plane of a door, the handle connection mechanism comprising: a frame securable to the door, the frame having a cam cavity extending transversally to the rotation axis, the cam cavity having a major depth along a first radial axis, a minor depth along a second radial axis, and a camming face having a reducing radial depth along a camming angle extending from the major depth to the minor depth, a clip having a transversally-oriented planar body received in the cam cavity, the clip having a radially-outer edge configured to slidingly engage the camming face, a rotary holder rotatably mounted to the frame around the rotation axis, the rotary holder having a first handle engagement member and a clip holder, the clip holder allowing radial sliding displacement of the clip while preventing rotational displacement of the clip relative to the rotary holder, and a handle having a neck portion having a second engagement member tangentially engaged with the first engagement member, the handle having a transversal groove receiving a radially-inner edge of the clip.

In at least some embodiments, such a handle connecting mechanism can lead to a packaging having a smaller box, to lower inventory, and/or to easier management of the customization of locks with different kinds of levers or handles.

Many further features and combinations thereof concerning the present improvements will appear to those skilled in the art following a reading of the instant disclosure.

DESCRIPTION OF THE FIGURES

In the figures.

DETAILED DESCRIPTION

Figure 1A:
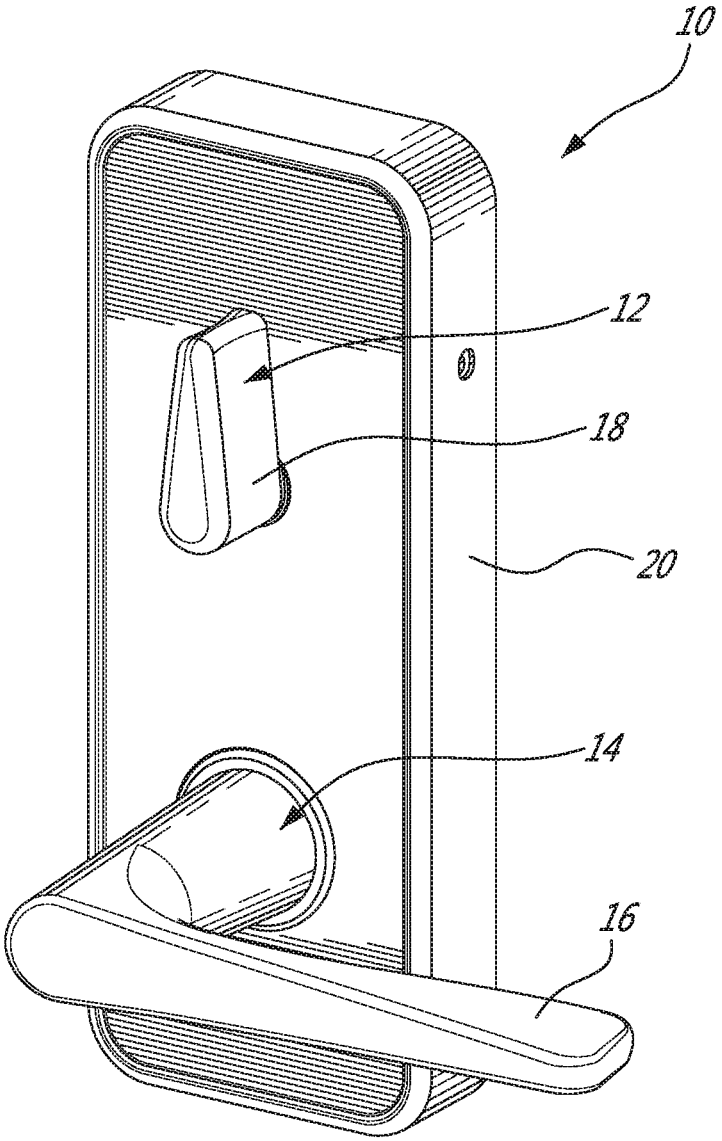
FIG. 1A is an oblique view of an embodiment of a trim assembly.
Figure 1B:
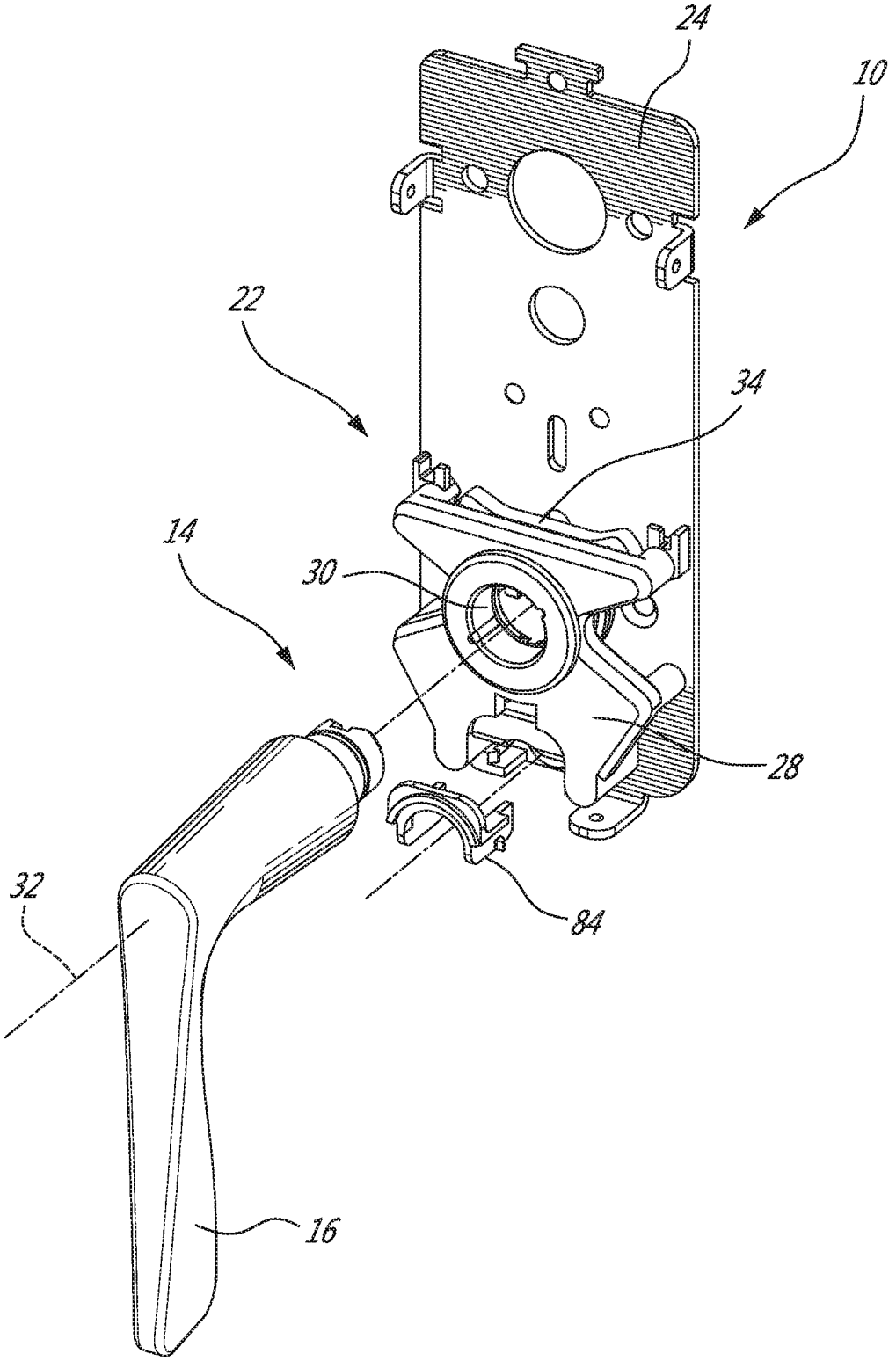
FIG. 1B is an another oblique view of the trim assembly of FIG. 1A, with a cover and turn knob mechanism removed, and a handle shown disassembled from a handle mechanism.

FIGS. 1A to 1B show an example of a trim assembly 10. In this specific example, the trim assembly has both a turn knob mechanism 12 and a handle mechanism 14. The handle 16 can be an internal handle simply connected to a latchbolt (not shown) and the turn knob 18 can be connected to a deadbolt (not shown), for instance. In FIG. 1B, the turn knob mechanism is omitted as it is optional, and the handle 16 is shown disassembled from the handle mechanism 14, with a cover 20 removed to allow visualizing internal components. At the installation site, the trim assembly 10 can be received with the handle 16 removed from the handle mechanism 14 such as shown in FIG. 1B.

As can generally be seen in FIG. 1B, the handle mechanism 14 generally has a frame 22 which is designed to be secured to a face of the door (not shown). In this specific embodiment, the frame has a plate portion 24 having a planar rear face 26 (see FIG. 1C) configured to be secured against a face of the door and to receive the cover 20, and a holder portion 28 offset from the plate portion 24. The holder portion 28 has a handle receiving aperture 30 (best seen in FIG. 1C) forming a handle receiving path aligned with the rotation axis 32 of the lock (and more specifically of the latchbolt mechanism in this specific embodiment). The handle mechanism 14 further has a rotary holder 34 which is rotatably mounted to the frame 22, and more specifically to the holder portion 28 thereof in this specific embodiment. The rotary holder 34 also has a handle receiving aperture forming the handle receiving path.

Figures 1C, 1D:
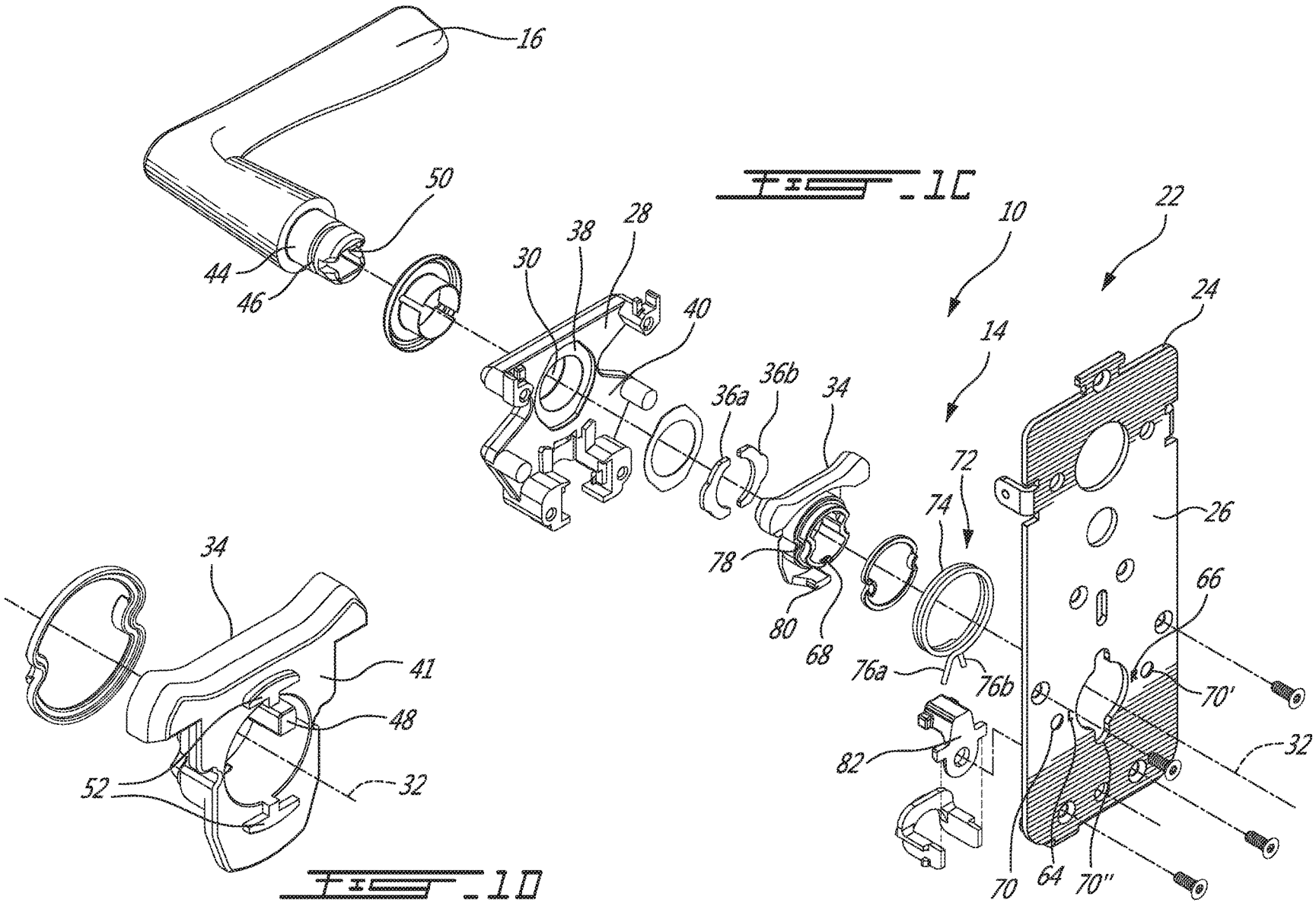
FIG. 1C is an oblique exploded view of the trim assembly of FIG. 1B.
FIG. 1D is an oblique view of a rotary holder of the trim assembly of FIG. 10, taken from a different side.

FIG. 1C shows an exploded view of the components which are shown assembled in FIG. 1B, including the holder portion 28 of the frame 22 and the rotary holder 34, from an oblique top and rear orientation. The rotary holder 34 is also shown in greater detail in FIG. 1D from an oblique top and front orientation.

A first aspect of the handle mechanism 14 is the axial retention mechanism. The axial retention mechanism is used to prevent the retraction of the handle 16 after assembly. The axial retention mechanism includes at least one clip 36*a*, 36*b*, which is axially trapped in a cavity 38. For reasons which will become apparent following further reading, this cavity 38 will be referred to herein as a cam cavity 38 in this specific embodiment, and can be seen to be axially recessed in an otherwise generally planar internal face 40 of the holder portion 28 of the frame 22, and generally covered by a corresponding face 41 the rotary holder 34 when the rotary holder 34 is rotatably assembled to the frame.

Figure 2B:
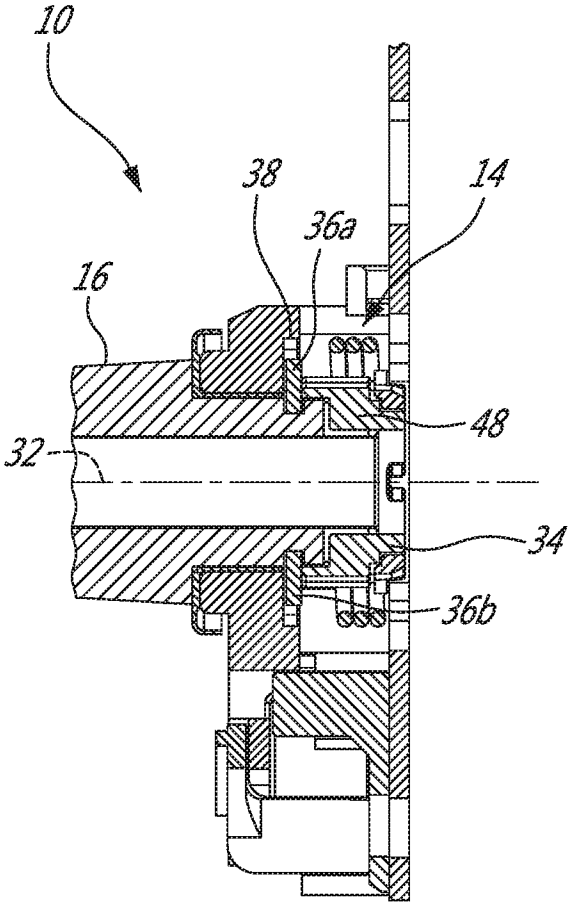
FIGS. 2A and 2B are cross sectional views taken along a sagittal plane showing the steps of inserting a neck portion of the handle into the handle mechanism.
Figure 2A:
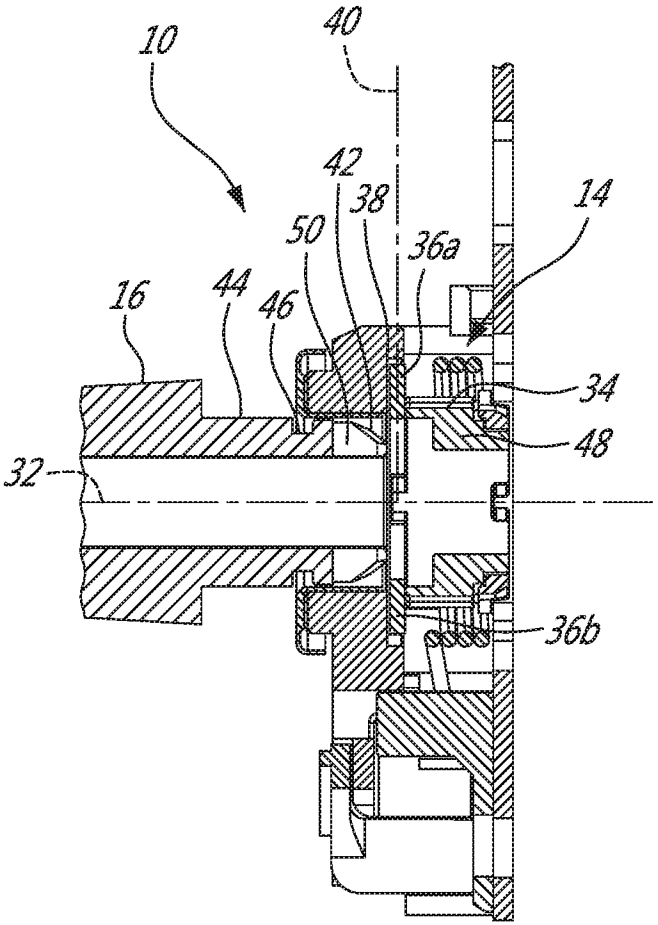

In this specific embodiment, there are two clips 36*a*, 36*b*, one on each transversal side of the rotation axis 32, this is optional and the purpose thereof will be detailed below. Though axially trapped, the clip 36*a* has some freedom of radial movement along radial axis 40 in the configuration shown in FIG. 2A, such that when a tapered tip 42 of the handle's neck portion 44 is pushed axially into the handle receiving path (i.e. into the configuration shown in FIG. 2B), the tapered tip 42 engages the clip 36*a* and pushes it radially outwardly (relative to the rotation axis 32) inside the cam cavity 38. The clip 36*a* can then slide axially along the neck portion until it reaches a mating groove 46 defined radially inwardly in the neck portion 44, at which stage the clip 36*a* can engage the groove 46 and thereafter prevent axial retraction of the handle 16, such as shown in FIG. 2B. It will be understood that at this stage, the engagement of the clip 36*a* with the groove 46 is still relatively loose as the clip 36*a* is free to move radially outwardly in the cam cavity 38. This freedom of movement of the clip 36*a* is removed in a subsequent step, which will now be detailed.

Referring back to FIGS. 10 and 1D, it can be seen that the rotary holder 34 has a first handle engagement member 48, and the handle 16 has a mating second engagement member 50. When the neck portion 44 of the handle 16 is introduced in the handle receiving path, the handle 16 is oriented in a manner for the mating first and second engagement members 48, 46 to be tangentially aligned, which allows full penetration of the neck portion 44 into the handle receiving path (e.g. configuration shown in FIG. 2B). Once the neck portion 44 has been fully advanced, the mating first and second engagement members 48, 50 are tangentially engaged with one another, in a manner that rotation of the handle 16 around the rotation axis 32 imparts a rotation movement to the rotary holder 34, and vice-versa. In this specific embodiment, the first engagement member 48 is provided in the form of a male, axially oriented tab whereas the second engagement member 50 is provided in the form of a female, axially oriented groove, but it will be understood that male and female can be inversed and that other suitable shapes can be used in alternate embodiments.

Also shown more clearly in FIG. 1D, the rotary holder 34 has a clip holder 52 (and more specifically has two transversally opposite clip holders, one for each clip, in this specific embodiment). The clip holder 52 is provided in a shape which allows radial freedom of movement of the clip 36*a*, but which prevents rotational (pivotal) displacement of the clip 36*a* relative to the rotary holder 34. Accordingly, rotary movement of the handle is also transferred into rotary movement of the clip 36*a* around the rotation axis 32. In this specific embodiment, this is achieved by providing the clip holder 52 with two cooperating internal faces both oriented parallel to a radial axis, and the clip 36*a* with two cooperating external faces, both oriented parallel to the radial axis, with the clip 36*a* trapped tangentially between, while being radially slidable against, the two cooperating internal faces of the clip holder 52, but this is design-specific and alternate shapes and configurations can be preferred or otherwise found suitable in alternate embodiments.

Figure 3B:
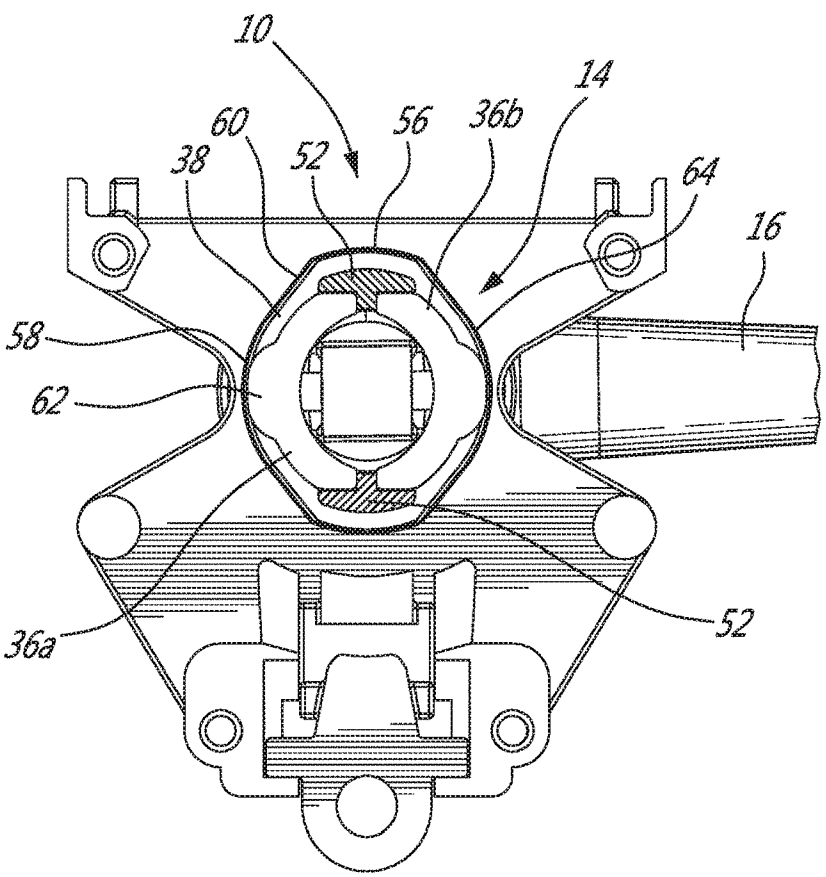
FIGS. 3A and 3B are cross sectional views taken along a vertical plane parallel to the external face of the door, showing the step of rotating the handle, and the rotary holder, into the operation configuration.
Figure 3A:
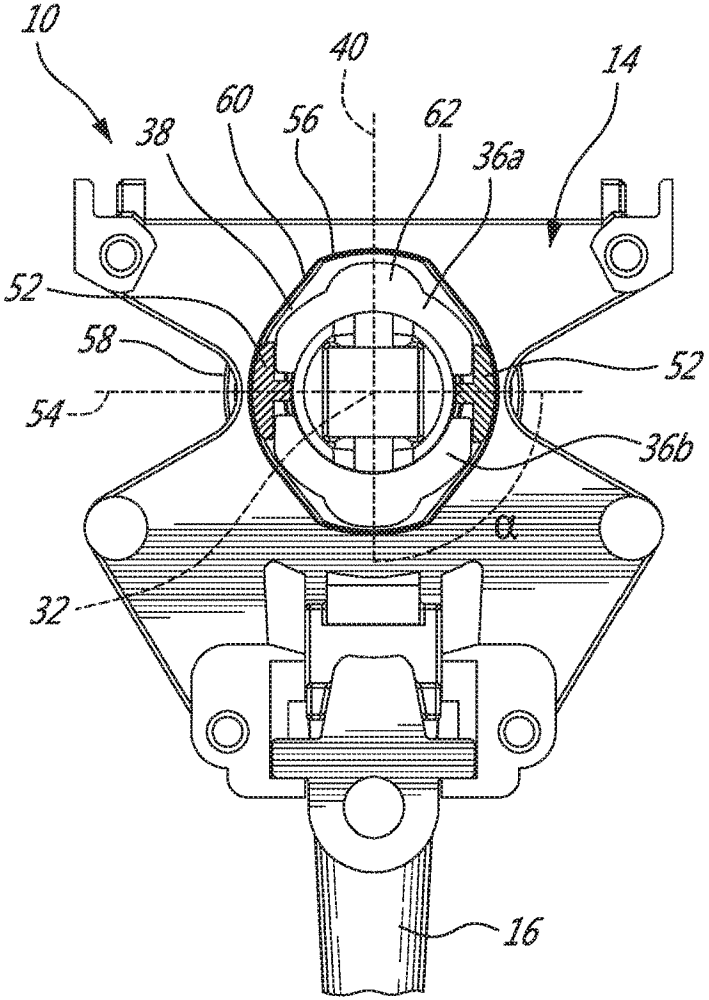

Referring now to FIGS. 3A and 3B, the shape of the clip 36*a,* of the clip holder 52, and of the cam cavity 38 are shown in greater detail. One can see, as apparent from comparing FIG. 3A to FIG. 3B, that the clip 36*a* can move radially inside the clip cavity 38 relative to the clip holder 52. However, it will be noted that the cam cavity 38 has different radial depths depending on the angular orientation around the rotary axis. Indeed, the cam cavity 38 can be said to have a major depth 56 aligned with a first radial axis 40, a minor depth 58 aligned with a second radial axis 54 and a camming face 60 having a reducing radial depth along the camming angle a extending from the first radial axis 40, or major depth 56, to the second radial axis 54, or minor depth 58. Conversely, the clip 36*a* has a radially-outer edge 62 configured to slidingly engage the camming face 60.

Accordingly, when the handle 16 is engaged with the rotary holder 34 as described above, and turned along the camming angle a, the radially-outer edge 62 of the clip 36*a* engages the corresponding camming face 60, and the camming face pushes the corresponding clip 36*a* radially inwardly into the groove 46, and radially traps the clip 36*a* in the groove 46 when the clip 36*a* is at the minor depth 58 of the camming cavity 38 such as shown in FIG. 3B.

On a side note, it will be noted that in this specific embodiment, the cam cavity 38 can be said to extend transversally relative to the rotation axis 32 in the sense that it extends parallel to the plane of the door (to which the rotation axis 32 is normal), and the clip 36*a* generally has a planar body shaped and sized to radially and pivotally slide in the cam cavity 38. It will be understood that this is design-specific. In alternate embodiments, the corresponding shapes of the clip and cam cavity may vary while still allowing similar functionality. Moreover, it will be noted that in this embodiment, the cam cavity 38 is provided in the form of an axial recess in an otherwise generally planar face 40 of the holder portion 28, and that the clip 36*a* is axially trapped by a corresponding face 41 of the rotary holder 34. This also is design specific. In alternate embodiments, it can be preferred to provide the cam cavity in the form of a radially extending cavity from a radially inner face of the holder portion, for instance, and the clip holders can accordingly be shaped in a manner to protrude radially into such a cavity, to name one example.

It will also be noted that here, the shape of the cam cavity 38 is symmetrical relative to a sagittal vertical plane coinciding with the axis 40, and has two camming faces 62, 64 (see FIG. 3B), one corresponding to each angular direction of rotation. This contributes to an optional bidirectional functionality of the handle mechanism 14 which will now be further detailed. However, it will first be noted that even without the bidirectional functionality, the handle engagement mechanism can be useful to some embodiments, to allow shipping of the handle separately from the remainder of the trim, and assembly of the handle on site. Accordingly, the bidirectional functionality is optional.

The bidirectional functionality is particularly useful in the case of a non-symmetrical handle as it can allow the handle to easily be assembled at the installation site either in a right side configuration or a left side configuration. This allows the selection of the configuration to be made at the installation site rather than during ordering, and can be advantageous for various reasons.

Various features cooperate to provide a suitable bidirectional functionality. Indeed, as shown in FIG. 1C, the rear face of the frame plate is provided with first and second "L" and a "R" markings 64, 66, corresponding respectively to the left side configuration and to the right side configuration. Moreover, the rotary holder 34 is provided with a third marking 68, such as an arrow in this case, which can be exposed across one or more corresponding apertures 70, 70', 70" in the frame plate 26, and which can allow the user to easily and intuitively align the rotary holder 34 in the initial configuration corresponding to the selected one of the left and right side configurations by manually turning the rotary holder 34 in a manner to align the third marking 68 with the corresponding one of the L and R markings 64, 66.

The handle 16 can then be engaged into the handle receiving path while being maintained in an angular orientation in which the lever is oriented vertically downwardly. The first and second engagement members 48, 50 of the handle 16 and rotary holder 34 are configured to be engageable with one another independently of the selected one of the two configuration, and to this end, can be made symmetrical along a corresponding sagittal plane coinciding with the rotation axis 32.

Figure 6B:
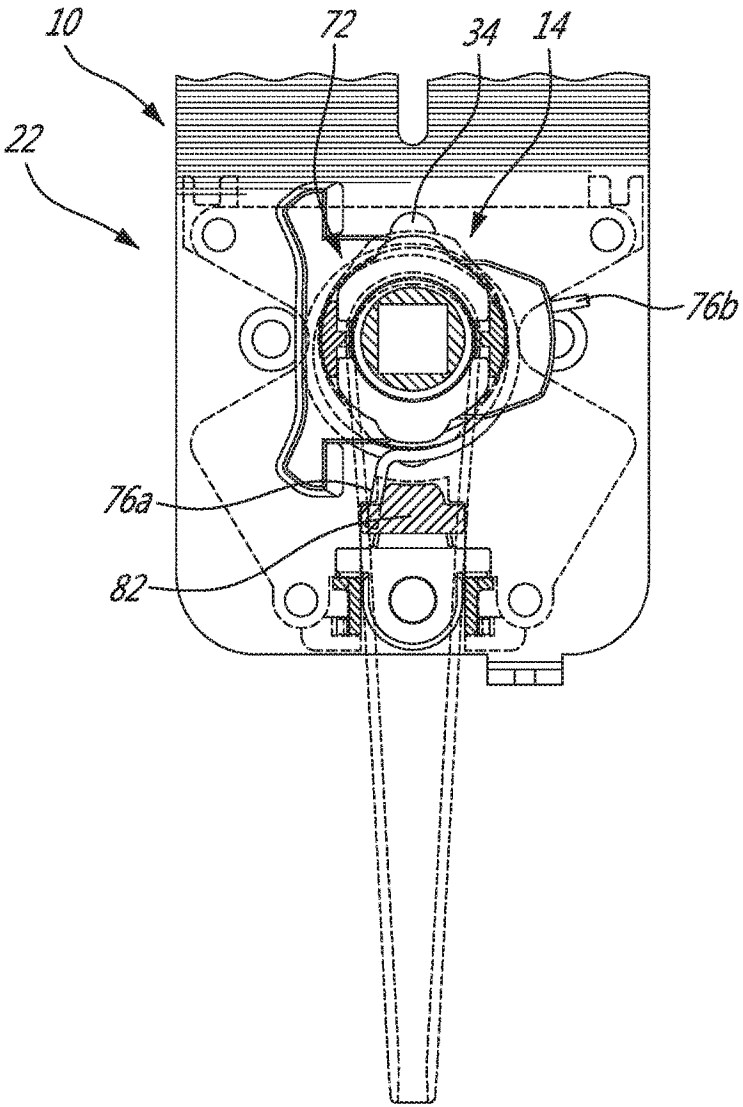
FIGS. 6A and 6B are cross-sectional views taken along a vertical plane illustrating the rotation of the handle which charges the torsion spring.

Similarly, it will be noted that when the handle 16 is activated to release the latchbolt, it will, to a certain extent, move the clip 36*a* from the configuration shown in FIG. 3B closer towards the configuration shown in FIG. 3A. Preferably, the span of angular movement of the handle 16 will be limited to prevent the clip 36*a* from moving completely to the major depth of the cam cavity, which can prevent the clip 36*a* from escaping the groove in the handle, but even in embodiments where full rotation of the clips to the major depth of the cam cavities is allowed upon activation of the latchbolt via the handle, such as shown in 6B for instance, the presence of two clips 36*a,* 36*b,* instead of a single one 36*a,* in the configuration illustrated, can ensure that in either one of the left side and right side configurations, there is always one of the two clips 36*a* and 36*b* which is located above the neck portion 44, and which is thereby biased into the groove 46 by gravity, when the clips are rotated towards the major depths of the cam cavities such as shown in FIG. 6B. The presence of two radially-opposite clips 36*a,* 36*b,* can involve, for suitable operation, the presence of two radially-opposite cam cavities (which are provided in the form of two communicating portions of a single, larger cavity 38 in this embodiment), and of two radially-opposite clip holders, which is the case in the illustrated embodiment. Using a symmetrical design for the clip holders, clips, and cam surfaces of the cam cavities relative to corresponding sagittal planes can allow the cam surfaces to operate the radially-inward bias upon both clips in either one of the angular rotation directions corresponding to the left side or right side configurations, respectively.

Figure 4B:
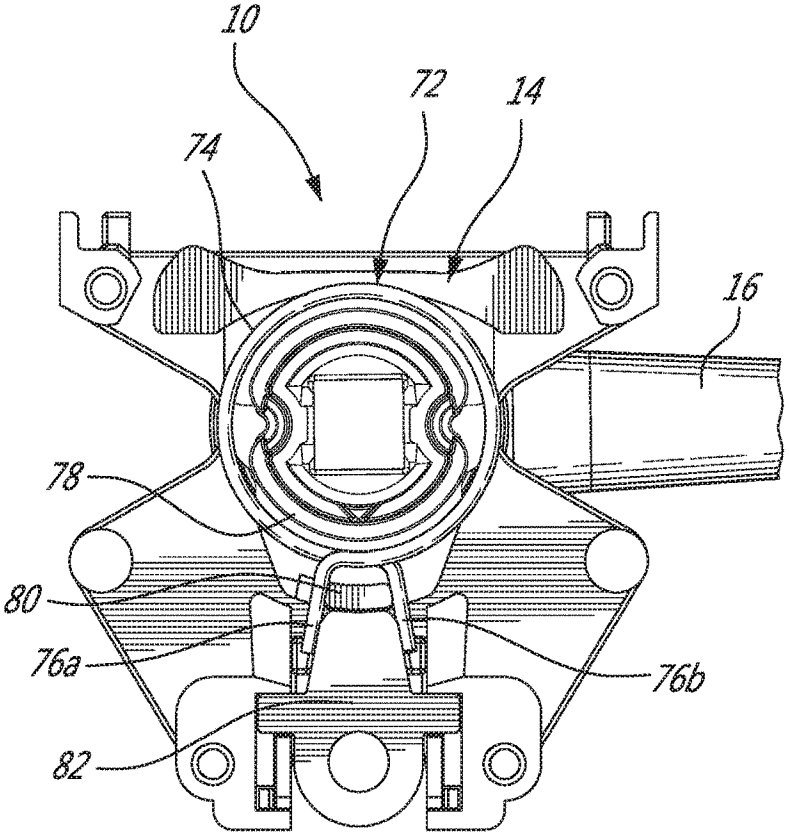
FIGS. 4A and 4B are other cross-sectional views taken along a vertical plane offset from the vertical plane of FIGS. 3A and 3B, showing the step of engaging a slidable spring stop with the torsion spring.
Figure 4A:
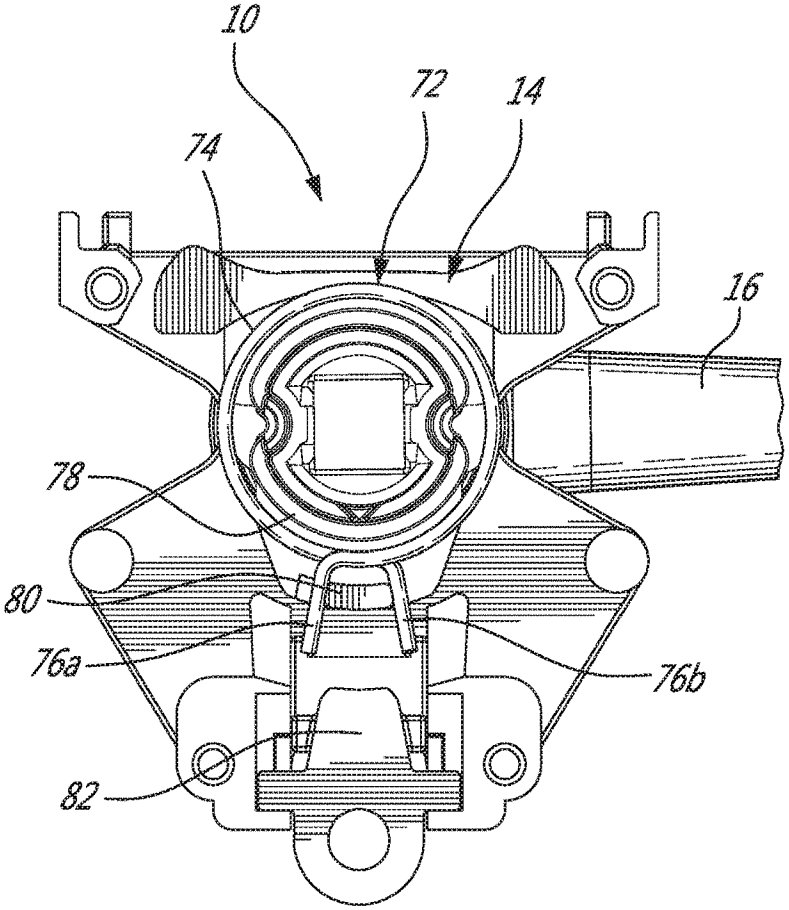
Figure 5B:
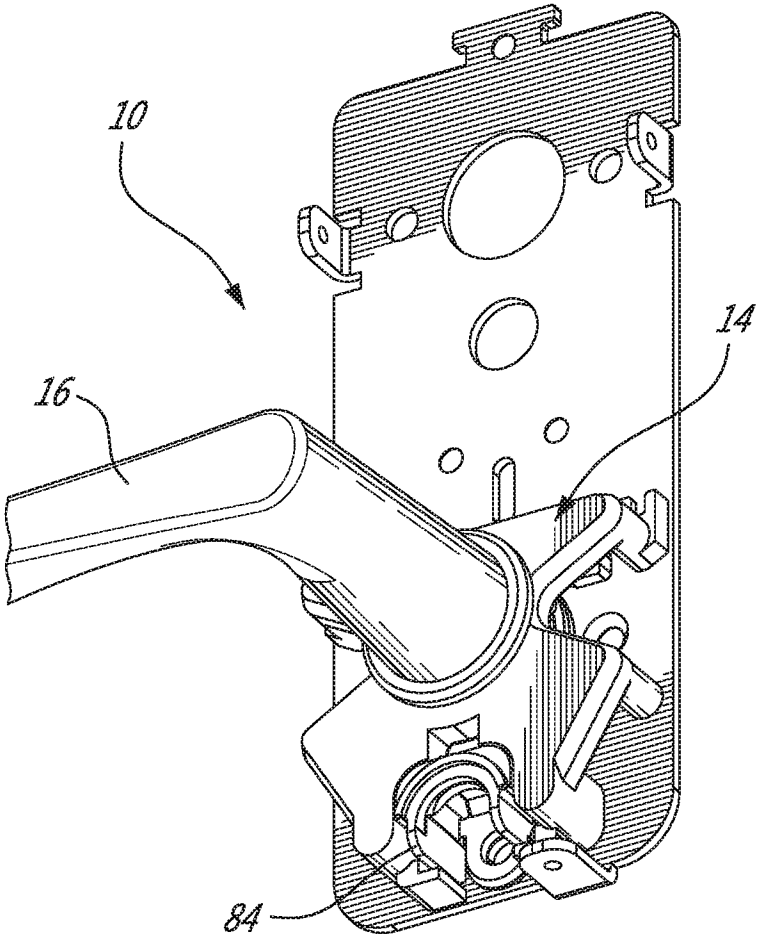
FIGS. 5A and 5B are oblique views showing the step of engaging a spring stop clip to lock the spring stop in the engaged position.
Figure 5A:
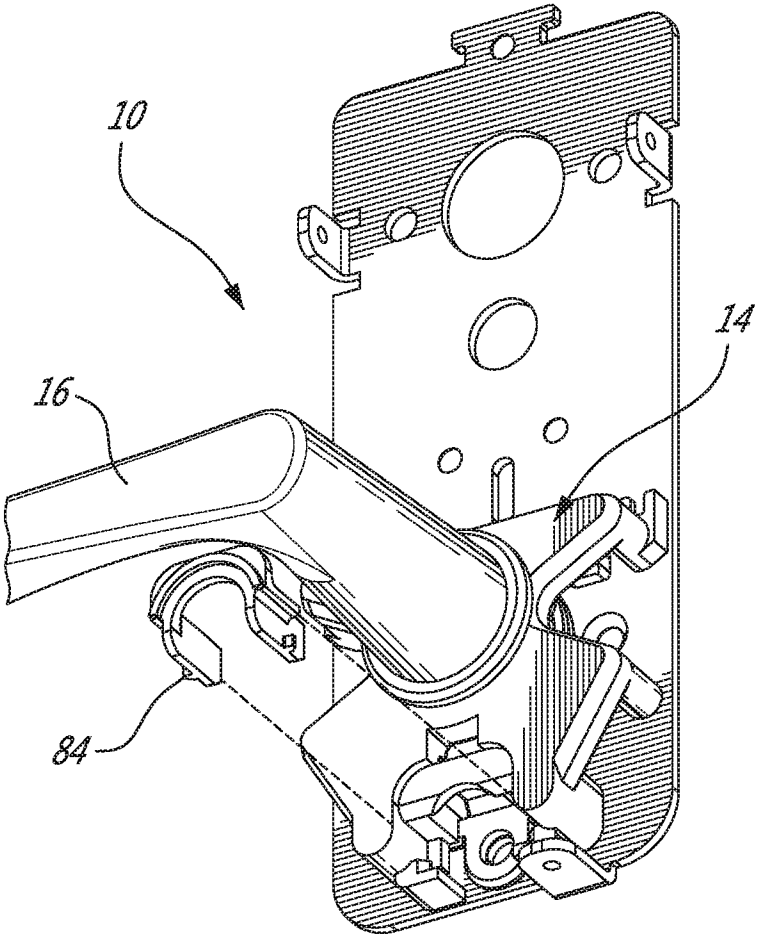

It will be understood by persons having ordinary skill in the art that while a handle mechanism can theoretically operate without a return spring, meaning that the return spring is theoretically optional, a commercial product would likely be manufactured with one. In this embodiment, a return spring is provided in the form of a torsion spring 72 which has a spiraling coil body 74 and two radially protruding tips 76*a,* 76*b*. Referring back to FIG. 1C, it will be seen that the rotary holder 34 is provided with a generally cylindrical wall 78 concentric to the rotation axis 32, which can receive a spiral of the torsion spring around it, and an axially protruding tab 80, which can receive a corresponding one of the two tips 76*a,* 76*b* on corresponding circumferential edges thereof. Accordingly, before finalizing the handle assembly, when the rotary holder 34 is rotated, the torsion spring 72 is rotated with it. When the handle 16 is rotated to the operating configuration such as shown in FIG. 3B (or the opposite operating configuration), the spring tips 76*a,* 76*b* are oriented vertically downwardly. A slidable spring stop 82 is provided in a sliding mount integrated to the holder portion 28 in this specific embodiment. At this point, the slidable spring stop 82 can be slid from the configuration shown in FIG. 4A to the configuration shown in FIG. 4B, into engagement between the radially protruding tips 76*a,* 76*b*. The spring stop 82 can then be locked in this engaged position, and in this embodiment, this is achieved via a spring stop clip 84. The spring stop clip 84, shown more clearly in FIGS. 5A and 5B, is configured to cooperate with a receiving feature of the holder portion 28, and can be axially engaged with the assembly in a manner to prevent undesired retraction of the spring stop 82.

Figure 6A:
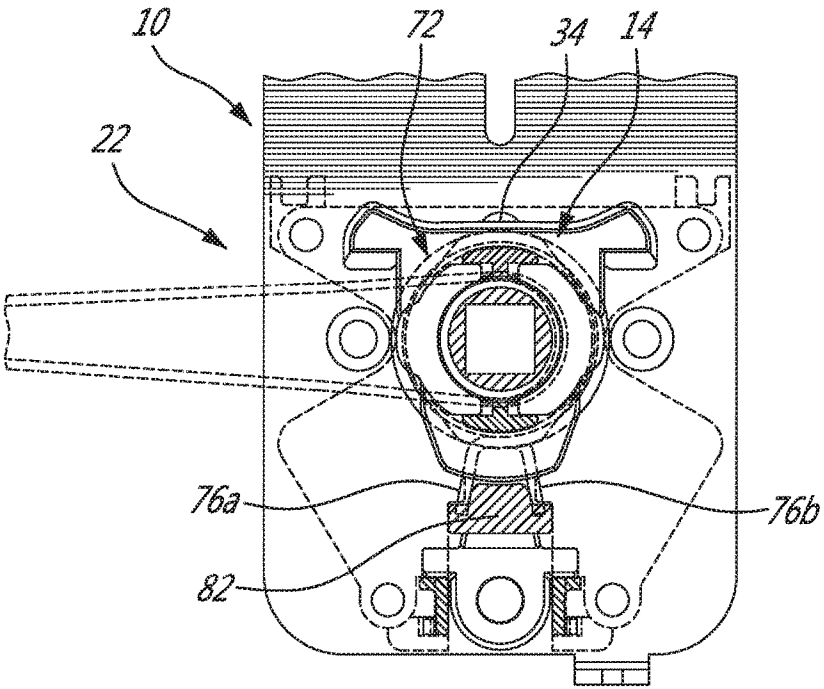

From this point on, rotary activation of the handle 16 to operate the lock will continue to transfer rotary movement to one of the tips (e.g. 76*b* but depends on the selected configuration) of the spring 72, but the other tip (e.g. 76*a*) of the spring will be blocked by the spring stop 82, such as shown in FIGS. 6A and 6B, building a progressively increasing returning spring force between the frame 22 and the rotary holder 34 as the handle 16 is being rotated. The spring force biases the handle back to its operating configuration shown in FIG. 6A. It will be noted here that again, the torsion spring operates independently of which one of the left side and right side configurations were selected at the installation site, given, for instance, the symmetry of the components which are involved.

Figure 7:
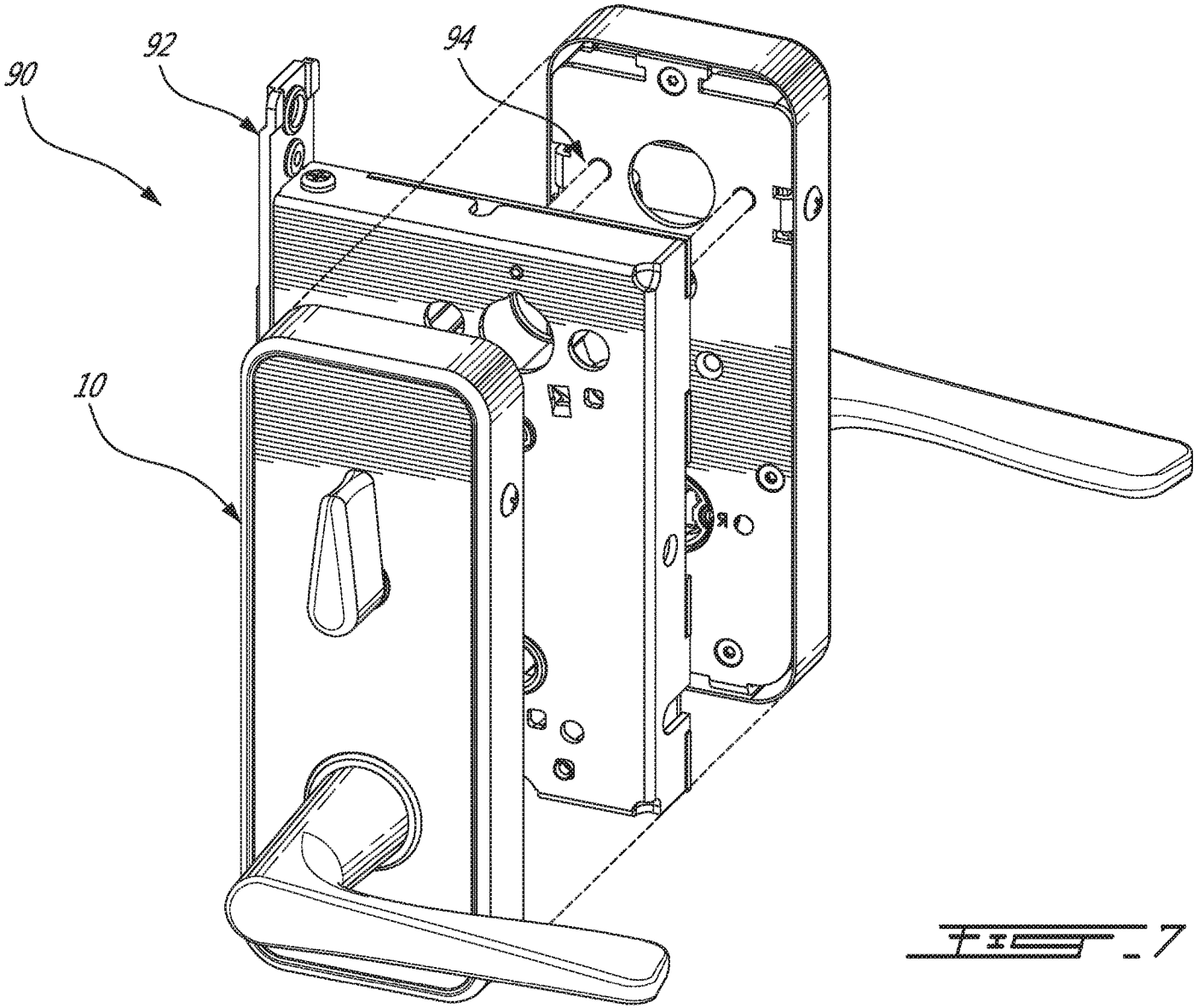
FIG. 7 is an oblique view of an example mortise lock system with which the trim assembly can be integrated.

FIG. 7 shows an example of a lock system 90 to which the trim 10 can be integrated. In this example, the lock system 90 is a mortise-type lock system and includes a pocket 92 to be integrated to the mortise in the door, an inner trim 10, and an outer trim 94.

As can be understood, the examples described above and illustrated are intended to be exemplary only. There are alternate ways of achieving a quick connection mechanism including both a primary axial engagement mechanism and a secondary axial engagement mechanism to lock the clip into the groove. For instance, in the embodiment illustrated, the groove is provided in the form of an annular groove surrounding the periphery of the neck portion. This is optional. Alternately, the groove can extend only on a portion of the periphery of the neck portion, and there can be a single, or more than one grooves, having a shape mating with the corresponding shape of the clip or clips. Moreover, in the illustrated embodiment, the frame is provided with a holder portion offset from a plate portion, and the rotary holder being positioned partially within the spacing between the holder portion and the plate portion. This also is design-specific. In an alternate embodiment, the rotary portion could extend outwardly from the holder portion rather than inwardly from the holder portion, for instance. Moreover, the handle connecting mechanism to attach the handle to a frame component of the lock can be embodied in different locations, or other frame components, of the lock. For instance, while in the embodiments presented above, the frame component of the handle connecting mechanism was part of an internal trim assembly for the lock, the handle connecting mechanism can alternately be made part of an external trim assembly for the lock, or even made integral to a frame component integrated to a mortise pocket itself, for instance. Indeed, there is a tendency on the market for locks to become smaller and smaller, and it may be advantageous to omit one or both trims on some designs, with the mortise inside the pocket of the door containing all the aspects of the lock (clutch, PCBs, unlocking of the mechanism). Moreover, the handle connecting mechanism can be adapted to other types of locks than mortise locks, such as a cylindrical unit, or ordinary latch lock, for instance. Indeed, the design can be easily applied in almost any lever hardware combination where it can be found suitable or advantageous, and especially those which have hardware which already limit the rotation of the lever to less than 90 degrees. In the case of the embodiment illustrated and detailed above, the hardware of the lock naturally limits the rotation angle of the handle to less than about 78 degrees, which was found suitable in this specific case. The scope is indicated by the appended claims.

What is claimed is:

1. A trim assembly for a lock having a rotation axis extending normal to a plane of a door, the trim assembly comprising:

a frame configured to be secured to a face of the door, the frame having a cam cavity extending transversally to the rotation axis, the cam cavity having a major depth along a first radial axis, a minor depth along a second radial axis, and a camming face having a reducing radial depth along a camming angle extending from the major depth to the minor depth, a clip having a transversally-oriented planar body received in the cam cavity, the clip having a radially-outer edge configured to slidingly engage the camming face, a rotary holder rotatably mounted to the frame around the rotation axis, the rotary holder having a first handle engagement member and a clip holder, the clip holder allowing radial sliding displacement of the clip while preventing rotational displacement of the clip relative to the rotary holder, a handle having a neck portion having a second engagement member tangentially engaged with the first engagement member, the handle having a transversal groove receiving a radially-inner edge of the clip.

2. The trim assembly of claim 1, further comprising a torsion spring rotationally engaged between the frame and the rotary holder in a manner to bias the handle to its position, whereby the handle can be manually turned against the bias to activate the lock.

3. The trim assembly of claim 2 wherein the return coil spring is rotationally engaged with the frame via a spring stop, the spring stop being selectively moveable into and out from interference with the torsion spring.

4. The trim assembly of claim 3 wherein the torsion spring has opposite tips received on opposite circumferential sides of a tab of the rotary holder, and on opposite circumferential sides of the spring stop.

5. The trim assembly of claim 2 wherein the clip is positioned horizontally to the side of the neck portion, and is pivoted to a position at least partially above the neck portion when the handle is manually turned against the bias to activate the lock.

6. The trim assembly of claim 1 wherein one of the first and second engagement members is an axially oriented tab and the other one of the first and second engagement members is a mating axially oriented groove.

7. The trim assembly of claim 1 wherein the clip is a first clip and the cam cavity is a first cam cavity, further comprising a second clip positioned transversally opposite to the first clip relative to the rotation axis, the second clip being received in a corresponding second cam cavity.

8. The trim assembly of claim 7 wherein the first cavity and the second cavity communicate with one another in a manner that the two clips can simultaneously be pivoted over 360 degrees around the rotation axis.

9. The trim assembly of claim 7 wherein the transversal groove is an annular groove extending around the entire periphery of the neck portion.

10. The trim assembly of claim 7 wherein frame has a plate portion having a planar rear face configured to be secured against a face of the door, the planar rear face having an aperture coinciding with the rotation axis, a first marking indicating a first handle orientation on a first side of the rotation axis, a second marking indicating a second handle orientation on a second side of the rotation axis, and the rotary holder has a third marking which can be selectively be aligned with the first marking or the second marking by turning the handle upon installation thereof, the third marking being visible from the rear face of the plate portion during installation of the handle.

11. The trim assembly of claim 1 wherein frame has a plate portion having a planar rear face configured to be secured against a face of the door, the planar rear face having an aperture coinciding with the rotation axis, a first marking indicating a first handle orientation on a first side of the rotation axis, a second marking indicating a second handle orientation on a second side of the rotation axis, and the rotary holder has a third marking which can be selectively be aligned with the first marking or the second marking by turning the handle upon installation thereof, the third marking being visible from the rear face of the plate portion during installation of the handle.

12. The trim assembly of claim 1 wherein the frame has a plate portion having a planar rear face configured to be secured against a face of the door, and a holder portion offset from the plate portion, the rotary holder being secured to the holder portion and extending axially at least partially between the holder portion and the plate portion.

13. The trim assembly of claim 12 wherein the cam cavity is provided in the form of an axial depression in the holder portion, the rotary holder having a front face axially trapping the clip in the cam cavity.

14. The trim assembly of claim 12 wherein the clip holder has two cooperating members protruding into the cam cavity, the cooperating member having two cooperating internal edges facing one another, both being parallel to a radial axis, with the clip being pivotally trapped therebetween.

15. A method of assembling a handle to a frame component of a lock having a rotation axis extending normal to a plane of the door, the method comprising:

introducing a neck portion of the handle in a receiving aperture of the frame and thereby positioning a second engagement member of the neck into a tangential engagement with a first engagement member of a rotary holder, and positioning a transversal groove defined in the neck portion in axial alignment with a clip axially trapped in a cam cavity of the frame, the clip further being tangentially trapped by the rotary holder but free to slide in a radial orientation relative to the rotary holder;

rotating the rotary holder around the rotation axis, via rotation of the handle, along a camming angle, the rotary holder thereby pivoting a clip around the rotation axis, inside a cam cavity, the cam cavity pushing the clip radially inwards during said pivoting, until it is engaged in the transversal groove, preventing axial retraction of the neck portion thereafter.

16. The method of claim 15 further comprising: during said rotating, rotating a torsion spring together with the rotary member, and subsequently to said rotating, engaging a spring stop into engagement with the torsion spring.

17. The method of claim 16 further comprising: subsequently to said engaging, turning the handle from an original position against a bias exerted by the torsion spring, the torsion spring subsequently returning the handle to its original position.

18. The method of claim 16 further comprising: engaging a stop clip between the frame and the spring stop, to lock the spring stop into its engaged position.

19. The method of claim 15 further comprising, prior to said introducing a neck portion of the handle, selecting one of a left sided and a right sided configuration, and rotating the rotary holder to a circumferential position corresponding to the selected configuration.

20. The method of claim 19 wherein the said rotating the rotary holder includes aligning a third marking on the rotary holder with a corresponding one of a first marking and a second marking provided on the frame.

21. A handle connection mechanism for a lock having a rotation axis extending normal to a plane of a door, the trim assembly comprising:

a frame configured to be secured to the door, the frame having a cam cavity extending transversally to the rotation axis, the cam cavity having a major depth along a first radial axis, a minor depth along a second radial axis, and a camming face having a reducing radial depth along a camming angle extending from the major depth to the minor depth, a clip having a transversally-oriented planar body received in the cam cavity, the clip having a radially-outer edge configured to slidingly engage the camming face, a rotary holder rotatably mounted to the frame around the rotation axis, the rotary holder having a first handle engagement member and a clip holder, the clip holder allowing radial sliding displacement of the clip while preventing rotational displacement of the clip relative to the rotary holder, a handle having a neck portion having a second engagement member tangentially engaged with the first engagement member, the handle having a transversal groove receiving a radially-inner edge of the clip.

* * * * *